US008231009B2

(12) United States Patent
Timmerman et al.

(10) Patent No.: US 8,231,009 B2
(45) Date of Patent: Jul. 31, 2012

(54) MAGNETIC SCREEN CLAMPING

(75) Inventors: Michael A. Timmerman, Cincinnati, OH (US); Benjamin L. Holton, Dayton, KY (US); James A. Marshall, Jr., Union, KY (US); Brian S. Carr, Burlington, KY (US)

(73) Assignee: M-I L.L.C., Houston, TX (US)

( * ) Notice: Subject to any disclaimer, the term of this patent is extended or adjusted under 35 U.S.C. 154(b) by 0 days.

(21) Appl. No.: 13/083,165

(22) Filed: Apr. 8, 2011

(65) Prior Publication Data

US 2011/0240531 A1 Oct. 6, 2011

Related U.S. Application Data

(63) Continuation of application No. 11/862,895, filed on Sep. 27, 2007, now Pat. No. 7,922,003.

(60) Provisional application No. 60/827,566, filed on Sep. 29, 2006.

(51) Int. Cl.
*B07B 1/46* (2006.01)

(52) U.S. Cl. ..... 209/395; 209/399; 209/403; 209/409

(58) Field of Classification Search ..... 209/395, 209/399, 403, 409–413; 269/8
See application file for complete search history.

(56) References Cited

U.S. PATENT DOCUMENTS 3,582,609 A * 6/1971 Morley et al. ..... 219/161
4,040,951 A * 8/1977 Cole ..... 209/408
5,045,184 A 9/1991 Arkles
5,816,413 A 10/1998 Boccabella et al.
7,850,142 B2 * 12/2010 Sladojevic et al. ..... 249/219.1
7,922,003 B2 * 4/2011 Timmerman et al. ..... 209/395
2011/0070058 A1 * 3/2011 Lindstrom ..... 414/592

OTHER PUBLICATIONS

Office Action issued in corresponding Canadian Patent Application No. 2,664,331; Dated May 9, 2011 (2 pages).

Office Action with English translation issued in corresponding Chinese Application No. 200780036408.2; Dated Sep. 23, 2011 (7 pages).

Examination Report with English language communication issued in corresponding Mexican Application No. MX/a/2009/003270; Dated Nov. 1, 2011 (4 pages).

* cited by examiner

*Primary Examiner* — Joseph C Rodriguez

(74) *Attorney, Agent, or Firm* — Osha Liang LLP

(57) ABSTRACT

A magnetic clamping system for a shale shaker including at least one screen having at least two side ends extending between a first side and a second side and at least one attachment surface. The system further includes at least one mating surface of the shale shaker configured to receive the at least one screen, and at least one magnet disposed between the at least one screen and the shale shaker, wherein the at least one magnet is configured to magnetically couple the at least one screen directly to the shale shaker. Additionally, the system includes at least one decoupling apparatus, the decoupling apparatus having a handle disposed proximate a perimeter of a shale shaker, and at least one shaft that extends horizontally between the handle and one of the at least one magnet, wherein the handle is rotatable to reverse the polarity of the magnet.

22 Claims, 10 Drawing Sheets

MAGNETIC SCREEN CLAMPING

CROSS-REFERENCE TO RELATED APPLICATIONS

The present application is a continuation application, and thus claims benefit pursuant to 35 U.S.C. §121, of U.S. patent application Ser. No. 11/862,895 filed on Sep. 27, 2007, currently pending, which claims priority under 35 U.S.C. §119 (e) to U.S. Provisional Application No. 60/827,566, filed Sep. 29, 2006. The contents of these applications are incorporated herein by reference.

BACKGROUND OF INVENTION

1. Field of the Invention

The present disclosure relates to methods and devices for clamping filter screens for oilfield shale shakers. More particularly, the present disclosure relates to magnetic clamps for securing filter screens in position.

2. Background Art

Oilfield drilling fluid, often called "mud," serves multiple purposes in the industry. Among its many functions, the drilling mud acts as a lubricant to cool rotary drill bits and facilitate faster cutting rates. Typically, the mud is mixed at the surface and pumped downhole at high pressure to the drill bit through a bore of the drillstring. Once the mud reaches the drill bit, it exits through various nozzles and ports where it lubricates and cools the drill bit. After exiting through the nozzles, the "spent" fluid returns to the surface through an annulus formed between the drillstring and the drilled wellbore.

Furthermore, drilling mud provides a column of hydrostatic pressure, or head, to prevent "blow out" of the well being drilled. This hydrostatic pressure offsets formation pressures thereby preventing fluids from blowing out if pressurized deposits in the formation are breeched. Two factors contributing to the hydrostatic pressure of the drilling mud column are the height (or depth) of the column (i.e. the vertical distance from the surface to the bottom of the wellbore) itself and the density (or its inverse, specific gravity) of the fluid used. Depending on the type and construction of the formation to be drilled, various weighting and lubrication agents are mixed into the drilling mud to obtain the right mixture. Typically, drilling mud weight is reported in "pounds," short for pounds per gallon. Generally, increasing the amount of weighting agent solute dissolved in the mud base will create a heavier drilling mud. Drilling mud that is too light may not protect the formation from blow outs, and drilling mud that is too heavy may over invade the formation. Therefore, much time and consideration is spent to ensure the mud mixture is optimal. Because the mud evaluation and mixture process is time consuming and expensive, drillers and service companies prefer to reclaim the returned drilling mud and recycle it for continued use.

Another significant purpose of the drilling mud is to carry the cuttings away from the drill bit at the bottom of the borehole to the surface. As a drill bit pulverizes or scrapes the rock formation at the bottom of the borehole, small pieces of solid material are left behind. The drilling fluid exiting the nozzles at the bit acts to stir-up and carry the solid particles of rock and formation to the surface within the annulus between the drillstring and the borehole. Therefore, the fluid exiting the borehole from the annulus is a slurry of formation cuttings in drilling mud. Before the mud can be recycled and repumped down through nozzles of the drill bit, the cutting particulates must be removed.

One type of apparatus used to remove cuttings and other solid particulates from drilling mud is commonly referred to in the industry as a "shale shaker." A shale shaker, also known as a vibratory separator, is a vibrating sieve-like table upon which returning used drilling mud is deposited and through which substantially cleaner drilling mud emerges. Typically, the shale shaker is an angled table with a generally perforated filter screen bottom. Returning drilling mud is deposited at the top of the shale shaker. As the drilling mud travels down the incline toward the lower end, the fluid falls through the perforations to a reservoir below thereby leaving the solid particulate material behind. The combination of the angle of inclination with the vibrating action of the shale shaker table enables the solid particles left behind to flow until they fall off the lower end of the shaker table.

The above described apparatus is illustrative of one type of shale shaker known to those of ordinary skill in the art. In alternate shale shakers, the top edge of the shaker may be relatively closer to the ground than the lower end. In such shale shakers, the angle of inclination may require the movement of particulates in a generally upward direction. In still other shale shakers, the table may not be angled, thus the vibrating action of the shaker alone may enable particle/fluid separation. Regardless, table inclination and/or design variations of existing shale shakers should not be considered a limitation of the present disclosure.

Preferably, the amount of vibration and the angle of inclination of the shale shaker table are adjustable to accommodate various drilling mud flow rates and particulate percentages in the drilling mud. After the fluid passes through the perforated bottom of the shale shaker, it may either return to service in the borehole immediately, be stored for measurement and evaluation, or pass through an additional piece of equipment (e.g., a drying shaker, a centrifuge, or a smaller sized shale shaker) to remove smaller cuttings and/or particulate matter.

Because shale shakers are typically in continuous use, repair operations, and associated downtimes, need to be minimized as much as possible. Often, the filter screens of shale shakers, through which the solids are separated from the drilling mud, wear out over time and subsequently require replacement. Therefore, shale shaker filter screens are typically constructed to be quickly removable and easily replaceable. Generally, through the loosening of several bolts, the filter screen may be lifted out of the shaker assembly and replaced within a matter of minutes. While there are numerous styles and sizes of filter screens, they generally follow similar design.

Typically, filter screens include a perforated plate base upon which a wire mesh, or other perforated filter overlay, is positioned. The perforated plate base generally provides structural support and allows the passage of fluids therethrough. While many perforated plate bases are flat or slightly arched, it should be understood that perforated plate bases having a plurality of corrugated or pyramid-shaped channels extending thereacross may be used instead. Pyramid-shaped channels may provide additional surface area for the fluid-solid separation process while guiding solids along their length toward the end of the shale shaker from where they are disposed.

In some shale shakers a fine screen cloth is used with the vibrating screen. The screen may have two or more overlying layers of screen cloth or mesh. Layers of cloth or mesh may be bonded together and placed over a support, supports, or a perforated or apertured plate. The frame of the vibrating screen is resiliently suspended or mounted upon a support and is caused to vibrate by a vibrating mechanism (e.g., an unbalanced weight on a rotating shaft connected to the frame). Each screen may be vibrated by vibratory equipment to create a flow of trapped solids on top surfaces of the screen for removal and disposal of solids. The fineness or coarseness of the mesh of a screen may vary depending upon mud flow rate and the size of the solids to be removed.

In typical shakers, a screen or screen assembly is detachably secured to the vibrating shaker machine. With the screen assembly or multiple screen assemblies secured in place, a tray is formed with the opposed, parallel sidewalls of the shaker. The drilling mud, along with drill cuttings and debris, is deposited on the top of the screen assembly at one side. The screen assembly is vibrated at a high frequency or oscillation by a motor or motors for the purpose of screening or separating materials placed on the screen. The liquid and fine particles will pass through the screen assembly by the acceleration of the screen assembly and will be recovered underneath. The solid particles above a certain size migrate and vibrate across the screen or screens where they are removed.

It is known that to obtain the proper vibration of the screen assembly, slack in the screens must be discouraged. Any slack in the screen produces an undesirable flapping action of the screen, which reduces the effectiveness of the shaker vibration and also results in increased wear of the screen. Accordingly, it is known that the screen should be securely and tightly held down to the vibrating machinery by an attachment mechanism.

One type of attachment mechanism includes hooks on each longitudinal end of the screen assembly to connect to the shaker. The shaker will have a channel-shaped drawbar on each side, which mates with a corresponding hook on the screen assembly. The drawbars are held in place by bolts or other fasteners. These are detachably connected so that the screens may be replaced from time to time. Such screens are referred to in the industry as "hookstrip screens."

Typically, hookstrip screens are manufactured by first forming a metal perforated plate (i.e., a backplate) which serves as support structure for the screen assembly. The metal perforated plate is often heavy, expensive to manufacture, and blocks a substantial portion of potential screen area. During screen manufacture, a screen surface (i.e., a filtering element) is attached to the metal perforated plate with powder epoxy. When the powder epoxy is melted, and the screen surface attached to the metal perforated plate, the epoxy spreads over the screen surface thereby blocking screening surface. The bonding process is also relatively long, in some instances lasting anywhere from 5 to 15 minutes.

In another type of current attachment mechanism, illustrated in FIG. 1, a shaker screen 11 is typically installed in, or secured to, shaker 10 with a wedge block 12 and a wedge block retainer bracket 14. The wedge block retainer bracket 14 may be an integral part of the shaker. The screen 11 is placed in position underneath the wedge block retainer bracket 14 and then the wedge block 12 is pounded into position so as to secure the screen 11 to the shaker 10. The operator often chooses to use a combination of a hammer and a suitable piece of wood in contact with the wedge block 12 to deliver sufficient force to fully tighten the wedge block. While the current wedge block system may be effective for installing screens, removing screens and replacing them using this method may take considerable time and be labor intensive.

Accordingly, there exists a need for a cost efficient attachment mechanism that does not substantially block a screening surface for the filtering of drilling fluids. Also, there exists a need for a quicker method of removing and installing screens.

SUMMARY OF INVENTION

In one aspect, embodiments disclosed herein relate to a magnetic clamping system for a shale shaker including at least one screen having at least two side ends extending between a first side and a second side and at least one attachment surface, at least one mating surface of a shale shaker configured to receive at least one screen, wherein the shale shaker has a first end and a second end, and at least on magnet disposed between the at least one screen and the shale shaker, wherein the at least one magnet is configured to magnetically couple the at least one screen to the shale shaker.

In another aspect, embodiments disclosed herein relate to a method for replacing a screen in a shale shaker, the method including activating at least one decoupling apparatus, wherein a magnetic clamping system includes the at least one decoupling apparatus, removing at least one screen from the shale shaker, deactivating the at least one coupling apparatus, and installing at least one screen into the shale shaker.

Other aspects of the present disclosure will be apparent from the following description and appended claims.

DETAILED DESCRIPTION

Generally, embodiments disclosed herein relate to methods and devices for attaching filter screens to oilfield shale shakers. Specifically, embodiments disclosed herein relate to magnets that magnetically couple screens to a shaker. Further, embodiments disclosed herein relate to a method of installing and removing a screen for a shale shaker.

Figure 1:
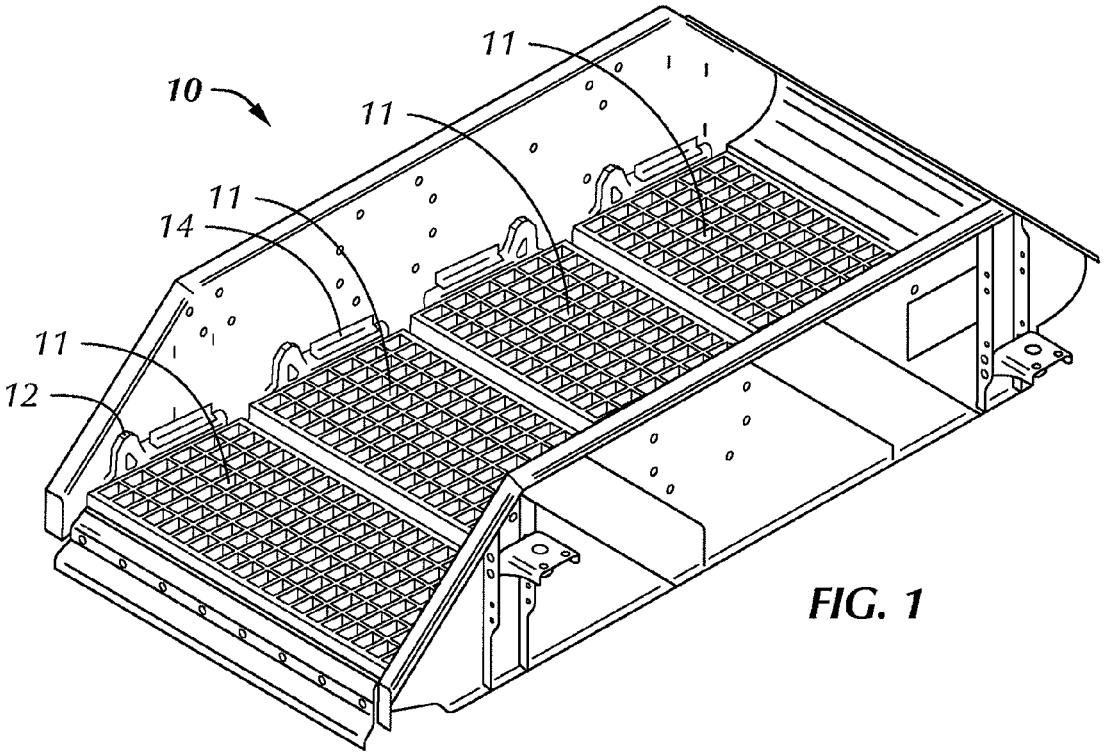
FIG. 1 shows a conventional shale shaker and wedge block system.
Figure 2A:
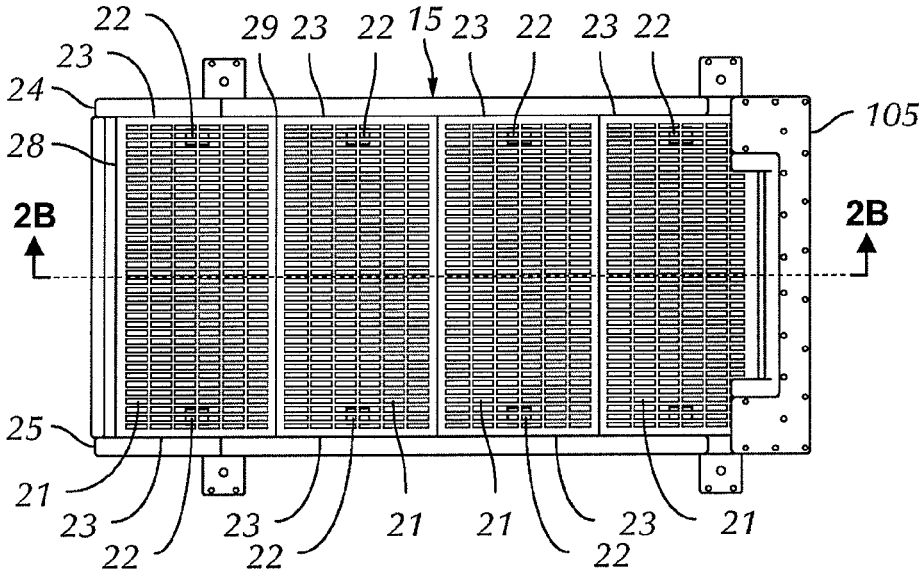
FIGS. 2A-2C is a shale shaker in accordance with embodiments disclosed herein.

Referring initially to FIG. 2A, a top view of a shaker basket 105 having a magnetic clamping system 15 in accordance with one embodiment of the present disclosure is shown. In this embodiment, the shaker 105 includes at least one filter screen 21. Each screen 21 has two side ends 23 extending between a first side 28 and a second side 29. Additionally, the screen 21 may include a composite frame, a wire structure and at least one filtering element. While four screens 21 are shown in FIG. 2A, one of ordinary skill in the art will appreciate that any number of screens and configuration of screens may be used without departing from the scope of the present disclosure. For example, in one embodiment there may be one row of four screens or in another embodiment, their may be two rows of four screens.

Figure 2B:
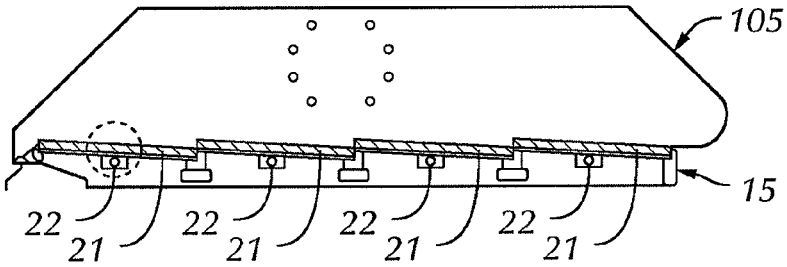
Figure 2C:
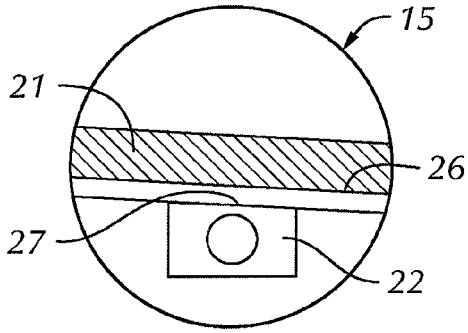

Referring now to FIGS. 2B and 2C, in one embodiment, magnetic clamping system 15 is shown. The magnetic clamping system 15 may include an attachment surface 26, which may be any area on the bottom surface of one or more screens 21 configured to magnetically couple to at least one magnet 22, wherein the magnet 22 may be attached to any area on the shaker basket 105 configured to receive attachment surface 26 of screen 21. Thus, attachment surface 26 may include an element such as iron, steel, or any other material known in the art that responds to a magnetic force. The magnet 22 may include a mating surface 27 configured to couple with attachment surface 26. Alternatively, in one or more embodiments, one of ordinary skill in the art will appreciate that a magnet may be integrally formed (not shown) within the shaker basket 105, such that mating surface 27 forms a portion of the shaker basket 105 configured to receive attachment surface 26. In another alternative, one or more embodiments may include at least one magnet (not shown) attached to screen 21, such that the corresponding magnet 22 attached to shaker basket 105 and the magnet attached to screen 21 are configured to magnetically couple together, thereby securing screens 21 to the shaker basket 105.

Still referring to FIGS. 2B and 2C, when attachment surface 26 of screen 21 is disposed proximate mating surface 27, the magnetic force between magnet 22 and attachment surface 26 secures screen 21 to shaker basket 105. As shown, at least one magnet 22 may be disposed proximate a center of each side end 23 of each screen 21. One of ordinary skill in the art will appreciate that magnet 22 may be attached to any portion of the shaker basket 105 (e.g., sides of shaker basket 105) by any means known in the art, for example, bolting, gluing, or welding.

In one embodiment, a screen 21 may include a composite frame. A composite frame may be formed from any material known to one of ordinary skill in the art including, but not limited to, plastics or combinations of stainless steel, metal alloys, plastics, etc. Composite frames in accordance with embodiments of the present disclosure may be formed by a number of methods known to those of ordinary skill in the art of plastics manufacture. One such method of forming composite frames may include injection molding and/or gas injection molding. In such an embodiment, a composite or polymer material may be formed around a wire structure and placed in a mold. The mold may be closed around the wire structure and a liquid polymer injected therein. Upon curing, a force may be applied to opposing sides of the mold thereby allowing the formed frame to separate from the mold. In alternate methods of injection molding, gas may be injected into a mold to create spaces in the composites that may later be filled with alternate materials. In another embodiment, these spaces may be filled with elements that respond to magnetic force, such as iron, steel or other material known in the art. Alternatively, these spaces may be filled with a magnetic material.

Figure 3A:
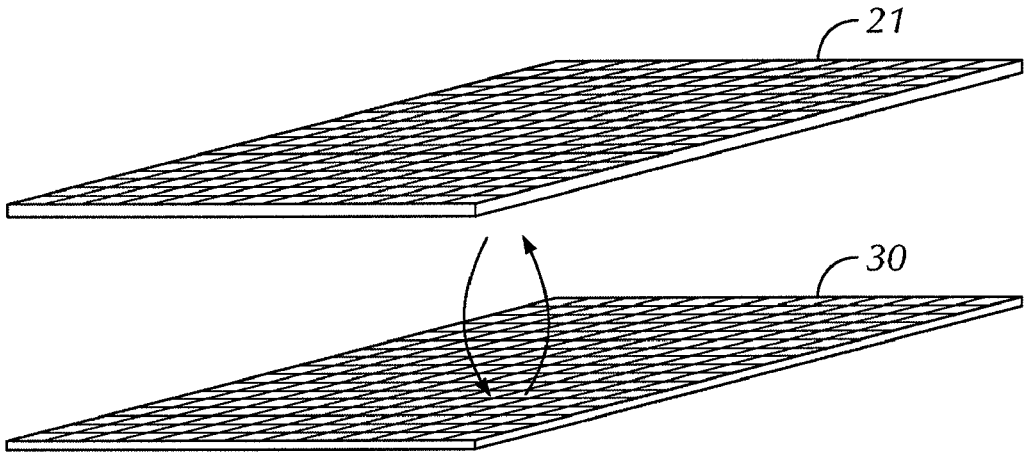
FIGS. 3A and 3B show filter screens in accordance with embodiments disclosed herein.
Figure 3B:
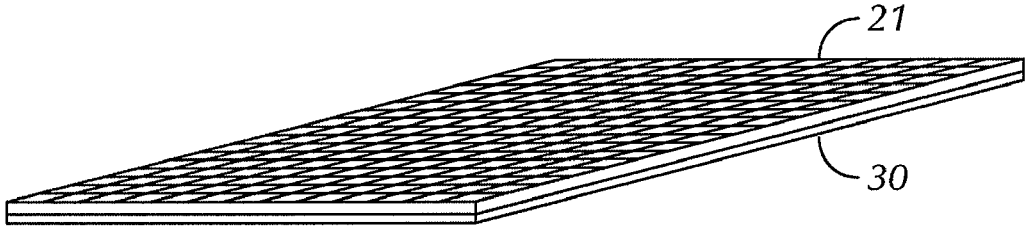

As illustrated in FIGS. 3A and 3B, screen 21 may also be formed to include a metal perforated plate 30 (e.g., a backplate) which is attached to the bottom surface of the screen 21. In one embodiment, the plate 30 may be attached with a powder epoxy. In this embodiment, the powder epoxy is melted and disposed between the bottom surface of the screen 21 and the metal perforated plate 30. Thus, the plate 30 is able to respond to magnetic force. One of ordinary skill in the art will appreciate that a magnet (not shown) attached to a shaker basket (not shown) may couple with the perforated plate 30 in order to secure screen 21 to the shaker basket.

Figure 4A:
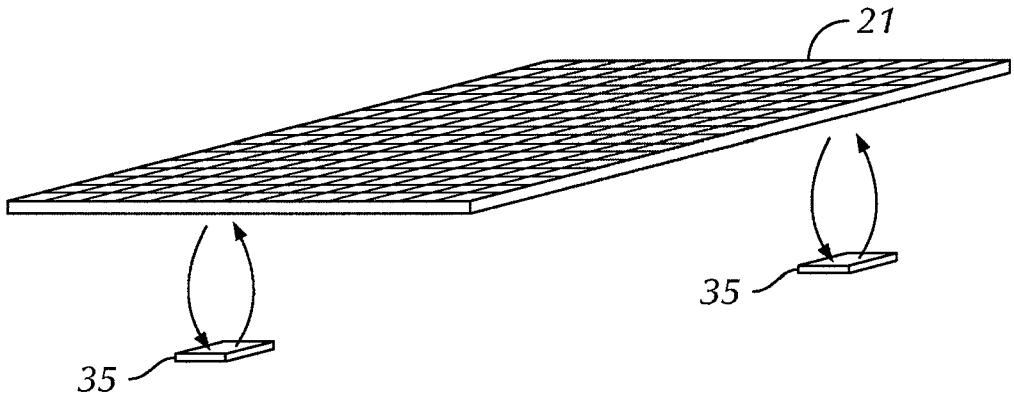
FIGS. 4A and 4B show filter screens in accordance with embodiments disclosed herein.
Figure 4B:
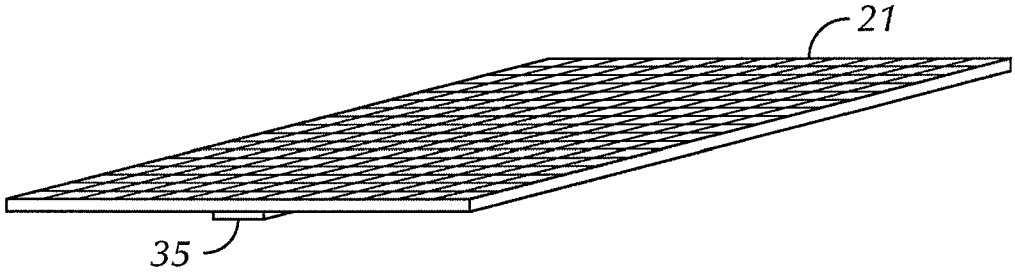

In another embodiment shown in FIGS. 4A and 4B, screen 21 may also be formed to include at least one metal plate 35. One of ordinary skill in the art will appreciate that the metal plate may either be attached to the screen 21, or integrally formed with the screen 21. Thus, the metal plate 35, configured to respond to magnetic force, may couple the screen 21 to a magnet (not shown) attached to a shaker basket (not shown). Accordingly, in this embodiment, the screen may be secured to a shaker basket when the metal plate 35 is coupled to the corresponding magnet. One of ordinary skill in the art will appreciate that the metal plate 35 is approximately the size of the magnet.

Figure 5A:
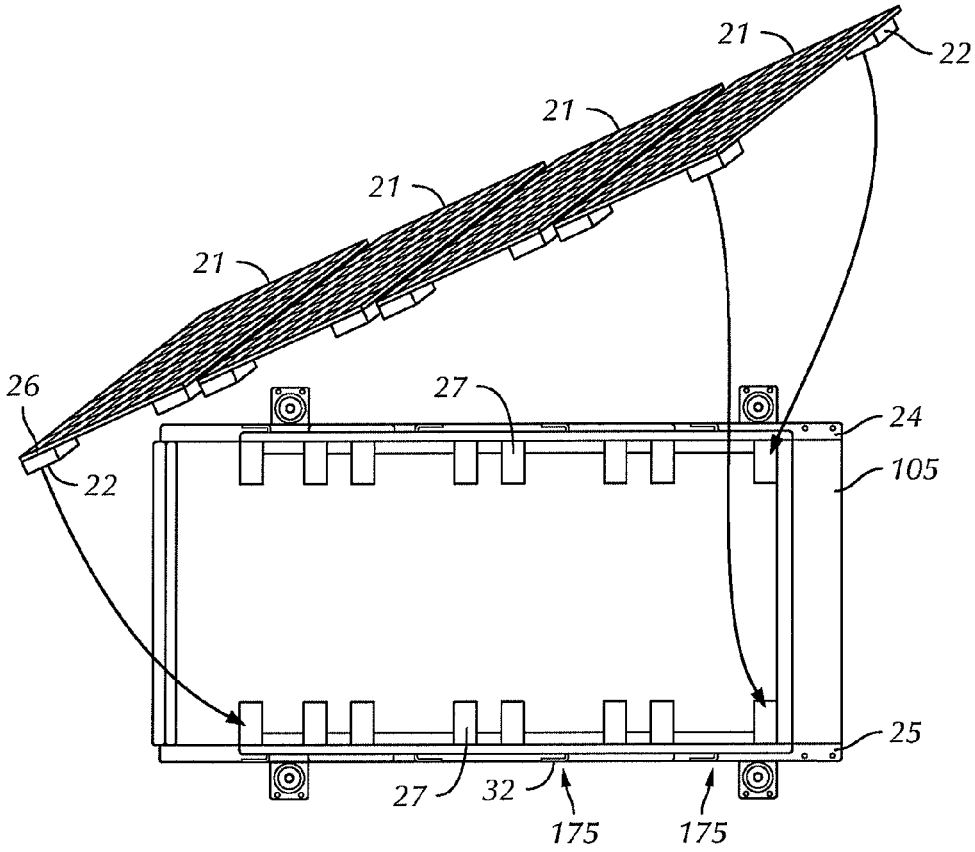
FIGS. 5A and 5B show a shale shaker in accordance with embodiments disclosed herein.
Figure 5B:
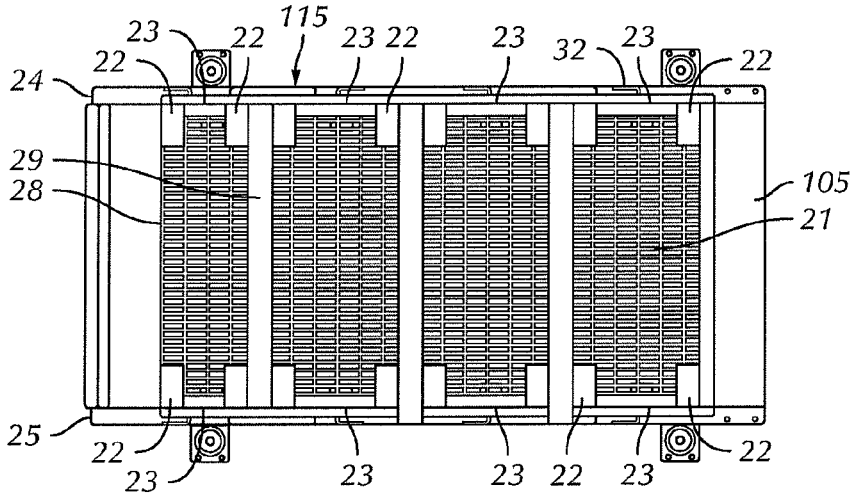

Referring now to FIGS. 5A and 5B, screen 21 may include at least one magnet 22 attached to an attachment surface 26 of screen 21. Further, at least a portion of shaker basket 105, referred to as mating surface 27, may comprise an element such as iron, steel, or any other material known in the art that responds to a magnetic force. Each mating surface 27 of shaker basket 105 is located in a position configured to receive the attachment surface 26 of screen 21. In this embodiment, the magnet 22 is configured to couple to the corresponding mating surface 27, thereby magnetically coupling the screen 21 to the mating surface 27 of shaker basket 105. The magnet 22 may be attached to the attachment surface 26 of screen 21 by any method known in the art, for example, bolting, screwing, welding, or an equivalent thereof. In this embodiment, the mating surface 27 may include an element such as iron, steel, or any other material known in the art that responds to a magnetic force. As screen 21 is placed into the shaker basket 105, the magnets 22 attached to the attachment surface 26 of the screen may couple with the mating surface 27 of the shaker basket 105.

Alternatively, one of ordinary skill will appreciate that in one or more embodiments, at least one magnet may also be attached to the shaker basket 105, such that at least one unattached end of the magnet is the mating surface 27 configured to couple with the corresponding magnet 22. Thus, the magnetic coupling between the magnet 22 attached to the screen 21 and the magnet (not shown) attached to the shaker basket 105 secures the screen 21 to the shaker basket 105. While four screens 21 are shown in FIG. 2A, one of ordinary skill in the art will appreciate that any number of screens and configuration of screens may be used without departing from the scope of the present disclosure. For example, in one embodiment there may be one row of four screens or in another embodiment, their may be two rows of four screens.

Referring now to FIG. 5B, a top view of a shaker basket 105 is shown having a magnetic clamping system 115 in accordance with this embodiment. The magnetic clamping system 133 includes all of the structural features as illustrated in FIGS. 2A-2C, however, magnets 22 may be positioned at different locations. As illustrated, at least one magnet 22 may be disposed proximate each corner of each screen 21. Those of ordinary skill in the art will appreciate that while certain numbers and locations of magnets 22 and mating surfaces 27 are shown, any number of combinations may be used.

Figure 6A:
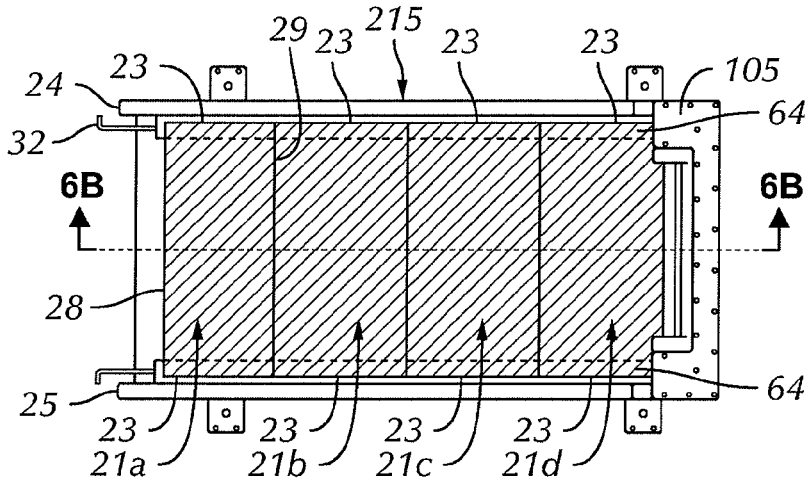
FIGS. 6A and 6B show a shale shaker in accordance with embodiments disclosed herein.

Turning now to FIG. 6A, a top-view of a shaker basket 105 having a magnetic clamping system 215 in accordance with another embodiment of the present disclosure is shown. In this embodiment, the shaker basket 105 has a first end 24 and a second end 25, and includes at least one filter screen 21. Each screen 21 has two side ends 23 extending between a first side 28 and a second side 29. Additionally, screen 21 may include a composite frame, a wire structure and at least one filtering element.

Figure 6B:
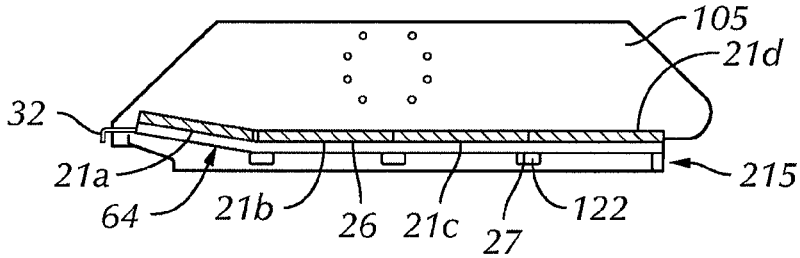

Referring now to FIG. 6B, in one embodiment, each screen 21 includes an attachment surface 26. Attachment surface 26 may be any area on the bottom surface of the screen 21 configured to magnetically couple to one or more magnets 64. Thus, attachment surface 26 may include an element such as iron, steel, or any other material known in the art that responds to a magnetic force. The magnetic clamping system 215 of this embodiment may include two magnets 64 attached to the shaker basket 105. Each magnet 64 may include a mating surface 27 configured to magnetically couple with the corresponding attachment surface 26. The magnet 64 may be attached to any area on the shaker basket 105 configured to receive attachment surface 26. In this embodiment, the magnet 64 may be attached to the top surface of at least one screen support 122. The screen support 122 forms a portion of the shaker basket 105. When attachment surface 26 of screen 21 is disposed proximate mating surface 27 of magnet 64, the magnetic force between magnet 64 and attachment surface 26 secures screen 21 to shaker basket 105. Alternatively, one of ordinary skill in the art will appreciate that in one or more embodiments, a magnet (not shown) may instead be fixed to the attachment surface 25 of screen 21 and the shaker basket 105 may comprise one or more mating surfaces 27 (e.g., top surface of screen support 122) comprising an element such as iron, steel, or any other material known in the art that responds to a magnetic force. Accordingly, the magnet 64 may be configured to magnetically couple to the mating surface 27 of the shaker basket 105, thereby securing the screen 21 to the shaker basket 105. In other embodiments, a magnet (not shown) may be attached to the top surface of at least one screen support 122 and a magnet may be fixed to the attachment surface 25 of screen 21.

Still referring to FIG. 6B, each magnet 64 may extend horizontally along shaker basket 105, extending from proximate the first side 28 of first screen 21*a* to proximate the second side 29 of last screen 21*d*. One magnet 64 may be disposed proximate to the first end 24 and another magnet 64 disposed proximate to the second end 25. One of ordinary skill in the art will appreciate that magnet 64 may be attached by any method known in the art, for example, bolting, gluing, welding, or equivalent thereof. Further, those of ordinary skill in the art will appreciate that while certain numbers, sizes, and locations of magnets 64 and mating surfaces 27 are shown, any number of combinations may be used.

Figure 7A:
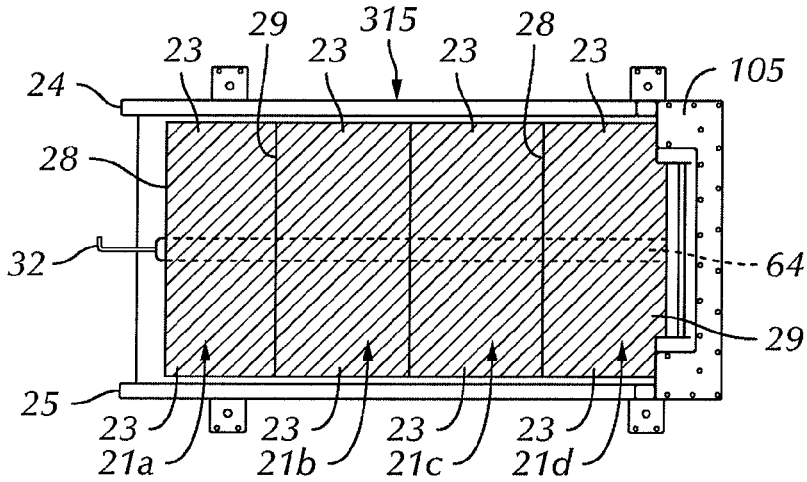
FIGS. 7A-7D show a shale shaker in accordance with embodiments disclosed herein.
Figure 7B:
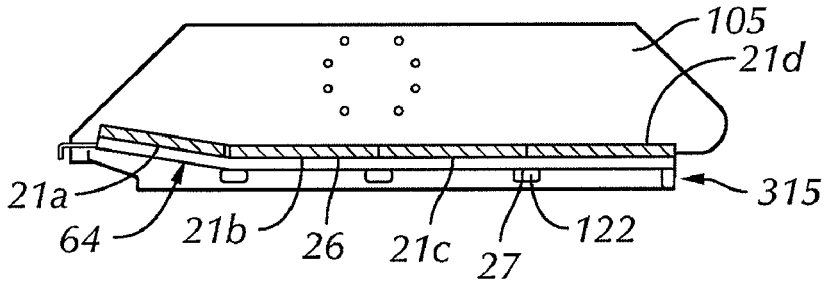

A top view of a shaker basket 105 having a magnetic clamping system 315 in accordance with another embodiment of the present disclosure is shown in FIGS. 7A-7D. This embodiment includes all of the structural features as illustrated in FIGS. 6A-6B, however, at least one magnet 64 may be positioned at a different location. As illustrated in FIGS. 7A and 7B, at least one magnet 64 may extend horizontally along the length of the shaker basket 105 extending from proximate the first side 28 of first screen 21*a* to proximate the second side 29 of last screen 21*d*.

Figure 7C:
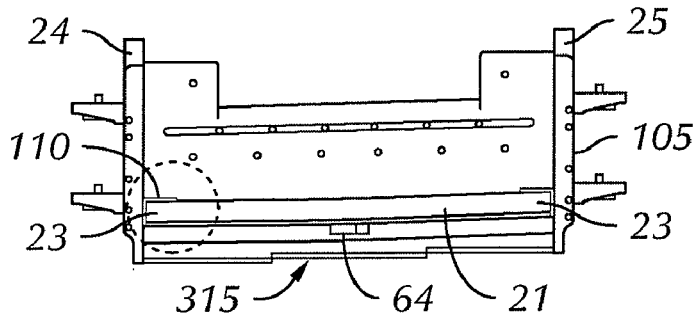
Figure 7D:
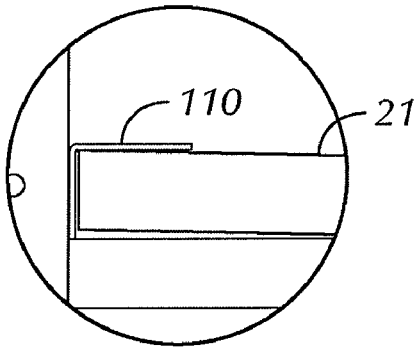

FIG. 7C is an end view of the embodiment shown in FIGS. 7A and 7B. As illustrated, at least one magnet 64 may be disposed a selected distance between the first end 24 and second end 25 of the shaker basket 105. As the center of each screen 21 is drawn downward by the force of magnet 64, the side ends 23 of each screen 21 may shift upwards. To prevent the displacement of each screen 21, at least one stop track 110 may be disposed proximate each midpoint of each screen side end 23, shown in FIGS. 7C-7D. Stop track 110 may be configured to hold at least one screen 21 in position. One of ordinary skill in the art will appreciate that stop track 110 may be composed of metals, plastics, or any material equivalent thereof. Further, one of ordinary skill in the art will appreciate that while certain numbers and locations of magnets 64 and stop tracks 23 are provided in embodiments disclosed, any number of combinations may be used.

In another embodiment, at least one magnet 64 may include adjacent individual magnets (not shown). This embodiment includes all of the structural features as illustrated in FIG. 7A, however, an array of magnets (not shown) may be disposed along the length of the shaker basket 105, such that when screens 21*a*-21*d* are disposed in shaker basket 105, they are substantially aligned with magnets 64. In one embodiment, a plurality of magnets (not shown) may be disposed adjacent one another. This arrangement of magnets may form a magnetic circuit positioned to achieve a particular magnetic field. For example, a magnetic circuit formed from the arrangement of magnets may provide magnetic flux into designated air gaps via, for example, metal components, thereby increasing the magnetic hold between the screens 21*a*-21*d* and the shaker basket 105.

Alternatively, this embodiment may include at least one magnet (not shown) that is attached to an attachment surface 26 of a screen 21 and is configured to couple the screen 21 to the mating surface 27 of a shaker basket 105. For example, at least one magnet (not shown) may be attached to the attachment surface 26 of a screen 21 by any method known in the art, for example, by bolting, gluing, welding, or any equivalent thereof. As the screen 21 is placed into the shaker basket 105, the magnets (not shown) attached to the attachment surface 26 of the screen 21, may couple to the mating surface 27 of the shaker basket 105. In this embodiment, the mating surface 27 may include an element that responds to magnetic force such as iron, steel, or any equivalent thereof known to an ordinary person skilled in the art.

Figure 8A:
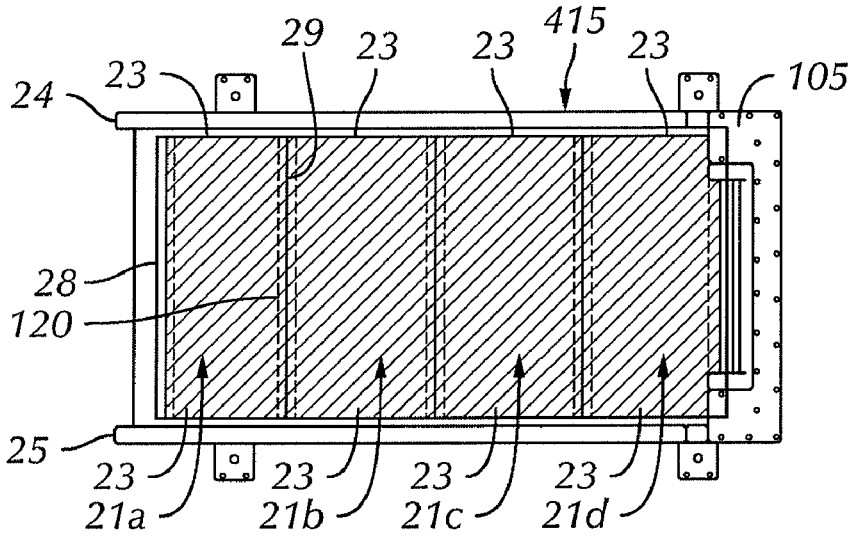
FIGS. 8A-8C show a shale shaker in accordance with embodiments disclosed herein.
Figure 8B:
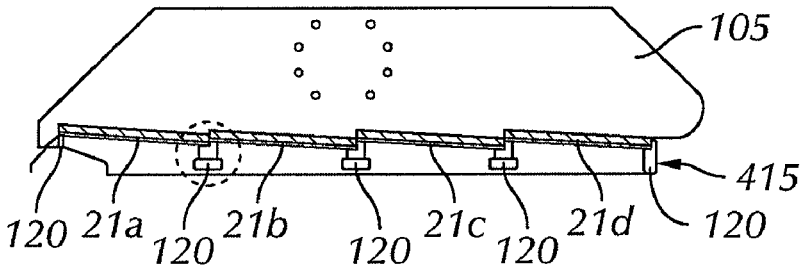
Figure 8C:
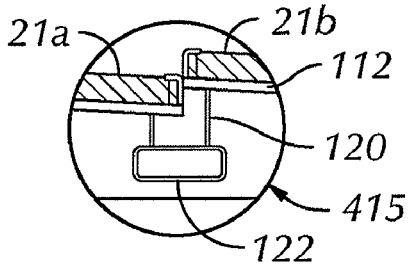

Referring now to FIGS. 8A-8C, a top view of an alternate magnetic clamping system 415 in accordance with one embodiment of the present disclosure is shown. In this embodiment, the shaker basket 105 has a first end 24 and a second end 25, and includes at least one screen 21. Each screen 21 has two side ends 23 extending between a first side 28 and a second side 29. Additionally, each screen 21 may include a composite frame, a wire structure and at least one filtering element. In this embodiment, the bottom surface of each screen includes an attachment surface 112, that may include an element that responds to magnetic force such as iron, steel, or any equivalent thereof known to an ordinary person skilled in the art. Further, the magnetic clamping system 415 of this embodiment may include at least one magnet 120 attached the shaker basket 105. The portions of the shaker basket attached to corresponding magnet 120 are referred to as mating surface 27. In this embodiment, the mating surface 27 may be the top surface of at least one screen support 122. At least one magnet 120 may extend from the first end 24 to the second end 25 of the shaker basket 105. Further, magnet 120 may be aligned proximate to a first side 28 or second side 29 of a screen 21. One of ordinary skill in the art will appreciate that the magnet 120 may be attached by any method known in the art, for example, by bolting, gluing, welding, or any equivalent thereof.

Referring now to FIG. 8C, in this embodiment, the attachment surface 112 of one screen 21*a* and an attachment surface 112 of an adjacent screen 21*b* are magnetically coupled to the same magnet 120. At least one magnet 120 may be disposed proximate to adjacent sides of a screen 21, such that while the magnet 120 exerts force, the screen 21 may be securely fastened to the shaker basket 105. One of ordinary skill in the art will appreciate that magnet 120 may be of any shape or size without departing from scope of embodiments disclosed herein.

Referring back to FIGS. 5A and 5B, in one embodiment, a decoupling apparatus 175 for decoupling screens 21 from shaker basket 105 is shown. At least one handle 32 is disposed proximate to perimeter of shaker basket 105 and is configured to reverse polarity of at least one magnet 22. Alternatively, in another embodiment (not shown), handle 32 may be disposed proximate to each magnet 22. As each handle 32 is turned, each corresponding magnet 22 rotates 180 degrees, thereby reversing polarity of each magnet 22. In this embodiment, each handle 32 controls the corresponding magnet 22 attached to the shaker basket 105, and magnetically coupled to the attachment surface 26 of each screen 21. One of ordinary skill in the art will appreciate that the handle 32 may be composed of any material known in the art and can be attached by any method, such as bolting, screwing or any equivalent method thereof. Further, one of ordinary skill in the art will appreciate that while certain numbers and locations of magnets 22 and handles 32 are provided in embodiments disclosed herein, a number of combinations may be used.

Figure 9A:
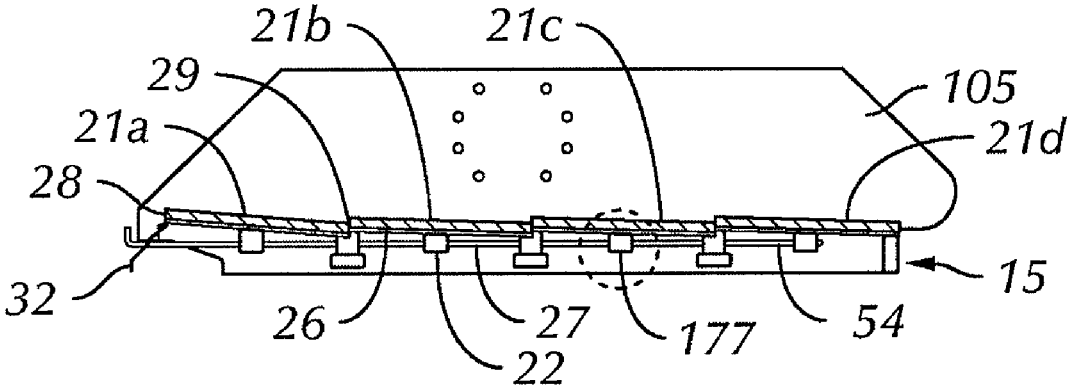
FIGS. 9A and 9B show a horizontally extending shaft for a decoupling apparatus in accordance with embodiments disclosed herein.
Figure 9B:
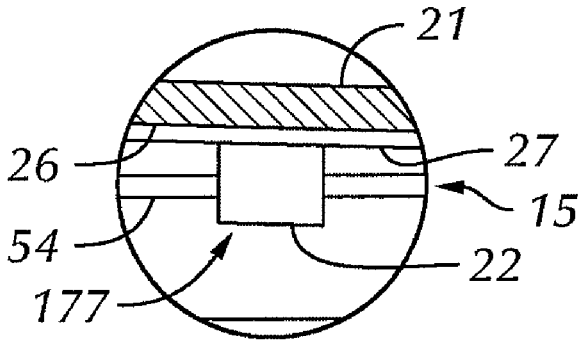

In another embodiment, as shown in FIGS. 9A and 9B, a decoupling apparatus 177 for decoupling screens 21 from shaker basket 105 is shown. At least one handle 32 disposed proximate to a perimeter of shaker basket 105 is configured to rotate a shaft 54. In this embodiment, at least one shaft 54 may extend horizontally from a first side 28 of the first screen 21*a* to the second side 29 of the last screen 21*d*. At least one shaft 54 may be configured to reverse polarity of an entire side of magnets 22. For example, referring to the cross sectional view of FIG. 9A, the shaft 54 may rotate the magnets 22 180 degrees, thereby reversing the polarity of the magnets 22. The position of the handle 32 in this embodiment is further illustrated in FIGS. 6A and 6B. Thus, in this example, the magnetic circuit may be broken or altered by moving one or more magnets.

Figure 10A:
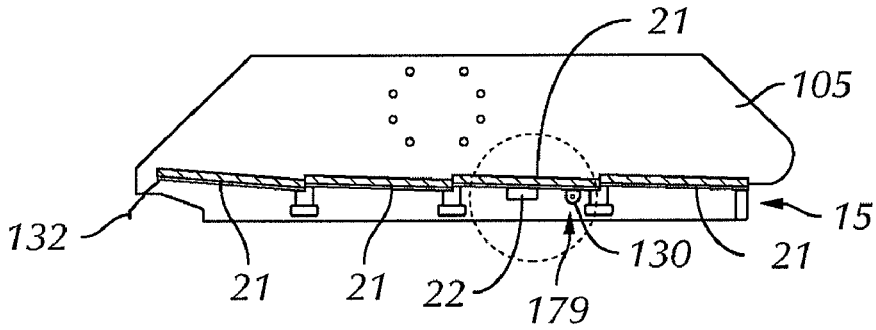
FIGS. 10A and 10B show a cam and crank system for a decoupling apparatus in accordance with embodiments disclosed herein.
Figure 10B:
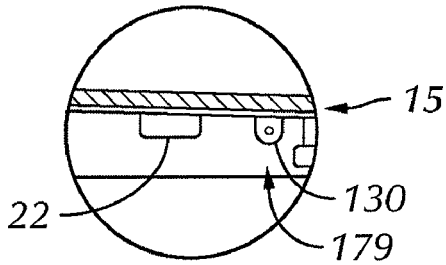

In another embodiment, as shown in FIGS. 10A and 10B, an alternate decoupling apparatus 179 for decoupling screens 21 from shaker basket 105 is shown. At least one crank 132 is disposed proximate to the perimeter of the shaker basket 105, and configured to rotate at least one cam 130 disposed within the shaker basket 105. One of ordinary skill in the art will appreciate that the cam 130 and crank 132 are composed of materials known in the current art such as metal, plastics, etc. and are attached by any method known in the art, for example, bolting, screwing, or any equivalent method. In this embodiment, as the crank 132 is rotated, the cam 130 rises within the shaker basket 105 to press up against the bottom surface of each screen 21 and thereby raising it from the shaker basket 105. Further, one of ordinary skill in the art will appreciate that while certain numbers and locations for cams 130, and cranks 132 are provided in embodiments, a number of combinations may be used.

Figure 11:
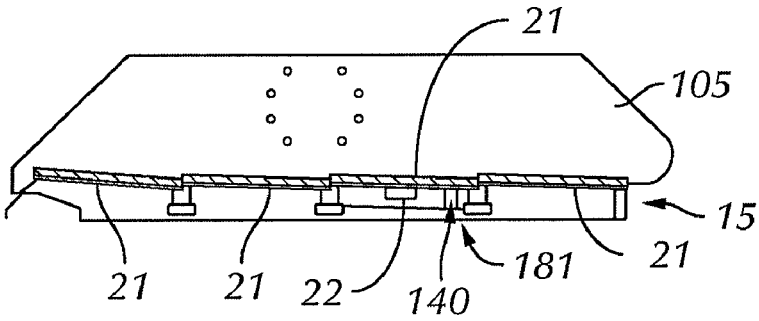
FIG. 11 shows an air/hydraulic bellow style actuator for a decoupling apparatus in accordance with embodiments disclosed herein.

Referring now to FIG. 11, an alternate decoupling apparatus 181 for decoupling screens 21 from shaker basket 105 is shown. At least one hydraulic actuator 140 may be disposed within the shaker basket 105 and below screen 21, and may be configured to press up against the screen 21 and raise it from the shaker basket 105. For example, the decoupling apparatus 181 may also include a piston (not shown) that may fit tightly inside the opening of the hydraulic actuator 140. In particular, the piston may be configured to change the volume by exerting a force on the fluid enclosed by the hydraulic actuator 140 The changing of volume may cause the hydraulic actuator 140 to press up against the screen 21, or to contract downward allowing the screen 21 to attach to the shaker basket 105. One of ordinary skill in the art will appreciate that inflatable screen gaskets, pneumatic actuators, air bellows, and hydraulic bellows or equivalent methods known in the current art may be used without departing from the scope of embodiments disclosed herein.

In alternate embodiments, a decoupling apparatus for a magnetic clamping system may include at least one air-actuated magnet, wherein an air-actuated magnet functions such that it provides clamping force at all times until it receives a pneumatic signal. In another embodiment, an alternate decoupling apparatus for a magnetic clamping system may include at least one electromagnet. A wire may be disposed along the perimeter of the shaker and an electric current runs therethough. In this embodiment, switching off an electric current may deactivate at least one electromagnet, thereby releasing its magnetic force. One of ordinary skill in the art will appreciate that an electromagnet may be composed of materials that when disposed proximate an electric current, takes on magnetic properties.

In the embodiments disclosed above, a magnet is attached to a surface of a screen and/or a component of a shaker basket. In alternate embodiments, a magnet may be placed or formed within a screen or shaker basket component. For example, a screen may be molded or formed with a magnet inside the frame of the screen. In this embodiment, an attachment surface of the screen corresponds to the location of the magnet within the screen. Thus, the magnetic force of the magnet in the screen may magnetically couple the screen to a corresponding mating surface of the shaker basket, as discussed above.

Advantageously, embodiments of the aforementioned apparatuses and methods may increase efficiency of shaker systems for the separation of drilling fluid from drill cuttings. As such, the cost of building, maintaining, and repairing shakers may be reduced. For example, whereas prior art cycle times for securing screens to shakers may take from 5-15 minutes, screens in accordance with embodiments disclosed herein may be bonded in a matter of seconds.

Finally, while the present disclosure has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A magnetic clamping system for a shale shaker, the magnetic clamping system comprising:

at least one screen comprising at least two side ends extending between a first side and a second side and at least one attachment surface;

at least one mating surface of the shale shaker configured to receive the at least one screen, wherein the shale shaker comprises a first end and a second end;

at least one magnet disposed between the at least one screen and the shale shaker wherein the at least one magnet is configured to magnetically couple the at least one screen directly to the shale shaker; and at least one decoupling apparatus comprising:

a handle disposed proximate a perimeter of the shale shaker; and at least one shaft that extends horizontally between the handle and one of the at least one magnet, wherein the handle is rotatable to reverse the polarity of the magnet.

2. The magnetic clamping system of claim 1, wherein the at least one decoupling apparatus is configured to decouple the at least one magnet from the at least one attachment surface.

3. The magnetic clamping system of claim 1, wherein the at least one decoupling apparatus is configured to decouple the at least one magnet from the at least one mating surface.

4. The magnetic clamping system of claim 1, wherein the at least one magnet is disposed proximate the center of at least one side end of the at least one screen.

5. The magnetic clamping system of claim 1, wherein the at least one magnet is disposed proximate at least one corner of the at least one screen.

6. The magnetic clamping system of claim 1, wherein the at least one magnet is a permanent rare earth magnet.

7. The magnetic clamping system of claim 1, wherein the at least one screen is a composite screen comprising a carbon steel cage encased in polymer.

8. The magnetic clamping system of claim 7, further comprising at least one metal plate attached to an attachment surface of the at least one screen.

9. The magnetic clamping system of claim 1, wherein the at least one screen comprises a metal frame.

10. The magnetic clamping system of claim 1, wherein at least one of a group consisting of at least one mating surface and at least one attachment surface comprises an element that responds to magnetic force.

11. The magnetic clamping system of claim 1, wherein the at least one screen comprises a first screen and a last screen.

12. The magnetic clamping system of claim 11, wherein the at least one magnet extends from proximate the first side of the first screen to proximate the second side of the last screen, and wherein the at least one magnet is disposed proximate at least one of the at least two side ends.

13. The magnetic clamping system of claim 11, wherein the at least one magnet extends from proximate the first side of the first screen to proximate the second side of the last screen, and is disposed a selected distance between the first end and second end of the shale shaker, and further comprising:

at least one stop track disposed proximate a midpoint of at least one of the at least two side ends and configured to hold the at least one screen in position.

14. The magnetic clamping system of claim 1, wherein the at least one screen comprises a first screen and a second screen, the first screen disposed adjacent the second screen, wherein an attachment surface of the first screen and a second attachment surface of the second screen are magnetically coupled to the at least one magnet that extends from the first end to the second end of the shale shaker, wherein the at least one magnet is aligned proximate at least one of a group consisting of the first side and the second side of the at least one screen, and wherein the at least one magnet is attached to at least one screen support.

15. The magnetic clamping system of claim 1, wherein the at least one magnet comprises a plurality of adjacent individual magnets.

16. The magnetic clamping system of claim 1, wherein the at least one attachment surface further comprises at least one magnet.

17. The magnetic clamping system of claim 1, wherein the at least one mating surface further comprises at least one magnet.

18. The magnetic clamping system of claim 1, further comprising a decoupling apparatus comprising an air actuated magnet with a pneumatic signal.

19. The magnetic clamping system of claim 1, further comprising a decoupling apparatus comprising a crank that moves a cam disposed adjacent a screen of the shale shaker.

20. The magnetic clamping system of claim 1, wherein the at least one screen comprises a first screen and a second screen, and wherein the at least one shaft extends horizontally from proximate the first side of the first screen to proximate the second side of the second screen.

21. The magnetic clamping system of claim 1, wherein the shaft is integrally formed with the handle.

22. The magnet clamping system of claim 1, wherein the handle is configured to move the at least one magnet.

* * * * *